United States Patent [19]

Liao

[11] Patent Number: 5,035,424

[45] Date of Patent: Jul. 30, 1991

[54] DEVICE FOR BATTING AND STRIKING PRACTICE

[76] Inventor: Leon Liao, No. 85-3, Yu Min St., Chang Hua City, Taiwan

[21] Appl. No.: 547,917

[22] Filed: Jul. 3, 1990

[51] Int. Cl.[5] ..... A63B 69/00

[52] U.S. Cl. ..... 273/26 R; 273/29 A; 273/185 D

[58] Field of Search ..... 273/26 R, 29 R, 29 A, 273/184 B, 185 C, 185 D, 196, 197 R, 197 A, 200 R, 200 A, 200 B, 58 C

[56] References Cited

U.S. PATENT DOCUMENTS

| | | | |
|---|---|---|---|
| 2,964,316 | 12/1960 | Rose | 273/26 R |
| 3,183,000 | 5/1965 | Dix | 273/29 A |
| 3,444,741 | 5/1969 | Burcz | 273/185 D |
| 3,743,296 | 7/1973 | Branz | 273/185 D |
| 3,830,504 | 8/1974 | Koo | 273/185 D |
| 4,204,678 | 5/1980 | Weis | 273/29 A |
| 4,531,734 | 7/1985 | Herrick | 273/58 C |
| 4,989,867 | 2/1991 | Herrick | 273/185 D |

*Primary Examiner*—Theatrice Brown

*Attorney, Agent, or Firm*—Zarley, McKee, Thomte, Voorhees & Sease

[57] ABSTRACT

A device for batting and striking practice includes a support coupled to an upper end of a base. The support includes a cable embedded in a shell. A body is integrally formed on an upper end of the support. Two elements are clamped to the lower end and the upper end of the cable. Each of the elements has one or more outward extending ring portion so that the cable is stably retained and embedded in the shell and the body.

5 Claims, 4 Drawing Sheets

DEVICE FOR BATTING AND STRIKING PRACTICE

BACKGROUND OF THE INVENTION

The present invention relates to a device, and more particularly to a device for batting and striking practice.

The closest prior art which applicant is aware is his prior U.S. Pat. No. 4,903,966 (Leon Liao, "Device for Batting and Striking Practice", Ser. No. 341,831, filed Apr. 24, 1989, issued Feb. 27, 1990. In this patent, the spring is connected between the ball-shaped body and the intermediate tube. The spring is not strong enough and is apt to be deformed after batting and striking practices.

SUMMARY OF THE INVENTION

The primary objective of the present invention is to provide a device for batting and striking practice which a sturdy and stout support for balls or the like.

In accordance with one aspect of the invention, there is provided a device for batting and striking practice which includes a support member coupled to an upper end of the base. The support member includes a core embedded in a shell. A body is integrally formed on an upper end of the support member. Two elements are clamped to the lower end and the upper end of the core. Each of the elements has one or more outward extending ring portions so that said core is stably retained and embedded in the shell and the body.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
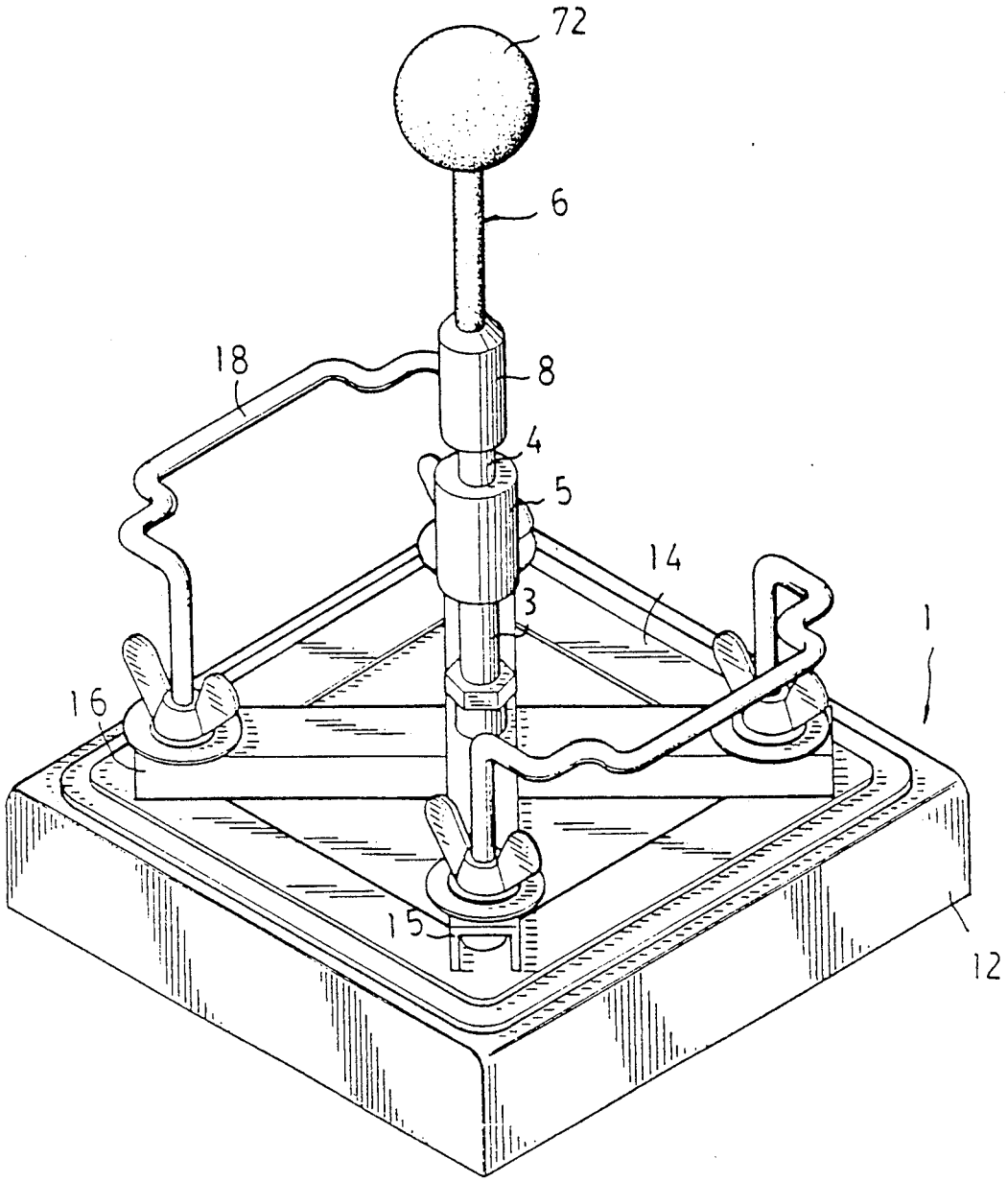
FIG. 1 is a perspective view of a device for batting and striking practice in accordance with the present invention.

Referring to the drawings and initially to FIG. 1, the device for batting and striking practice in accordance with the present invention comprises generally a base assembly 1, a lower tube 3, an intermediate tube 4 and a sleeve 5 which are identical to the structure as described in applicant's prior U.S. Patent. The base assembly 1 which is also identical to the base assembly as disclosed in the prior art comprises a pad 12, a base plate 14, an upper positioning channel member 15 and a lower positioning channel member 16. A pair of handlebars 18 are further coupled to the channel members 15, 16 by the wing nuts. The present invention is intended to improve the strength of the upper part of the device above the intermediate tube 4.

Figure 2:
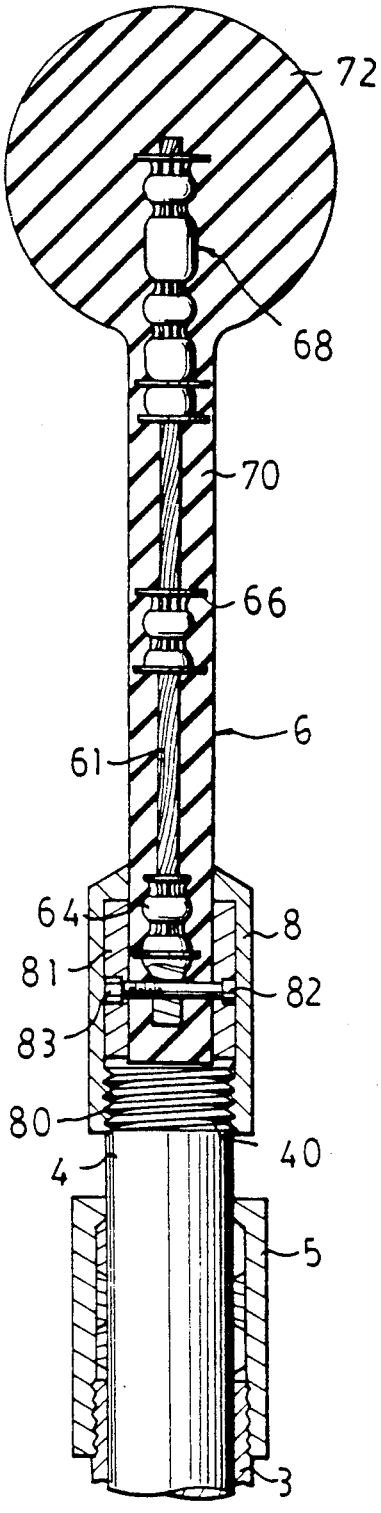
FIG. 2 is a cross sectional view of the upper portion of the device.
Figure 3:
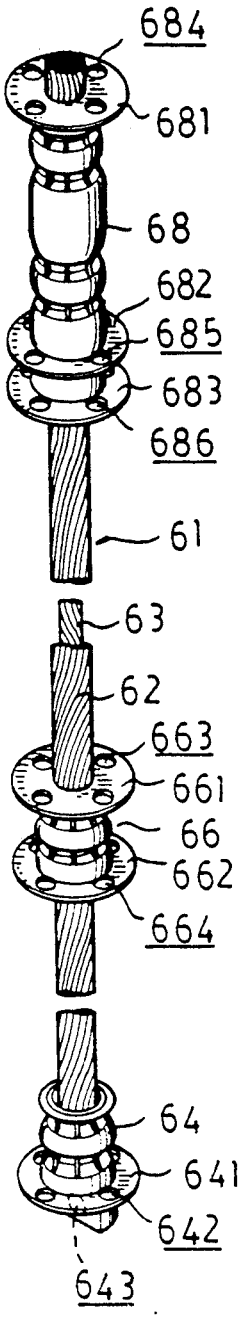
FIG. 3 is a perspective view of the core of the support member of the device.

Referring next to FIGS. 2 and 3, the upper part of the device includes a support member 6 coupled to the upper end of the intermediate tube 4 by a ferrule 8. The support member 6 includes substantially a core 61 and a shell 70. The core 61 which is a cable preferably includes an outer part 62 and an inner part 63. As shown in FIG. 3, the outer part 62 of the core 61 is a right-handed rotation; and, it is preferably that the inner part 63 is a left-handed rotation so that the core 61 has a higher strength to resist deformation or distortion.

Three hub-like elements 64, 66, 68 are squeezed, clamped or fastened to the lower end, middle, and upper end of the core 61 respectively. A ring portion 641 with a plurality of holes 642 formed therein extends laterally outward from the lower element 64. An aperture 643 is laterally formed through the lower end of the lower element 64. Two ring portions 661, 662 each with a plurality of holes 663, 664 formed therein extend outward from the upper end and the lower end of the middle element 66. Three ring portions 681, 682, 683 each with a plurality of holes 684, 685, 686 formed therein extend outward from the upper element 68; in which, the ring portion 681 is located at the upper end of the upper element 68, and the ring portions 682, 683 are located close to the lower end of the upper element 68.

The core 61 is embedded in the shell 70 which is formed by a molded method. A ball-shaped body 72 is integrally formed on the upper end of the support member 6. Alternatively, the body 72 can be formed with sponge-like material for boxing practice. The upper element 68 is substantially embedded in the body 72. The ring portions 641, 661, 662, 681, 682, 683 of the elements 64, 66, 68 are provided such that the core 61 is stably retained and embedded in the shell 70 and such that the shell 70 will not move longitudinally relative to the core 61. The material which forms the shell 70 and the body 72 fills the holes 642, 663, 664, 684, 685, 686 of the elements 64, 66, 68 during molding so that the core 61 is further stably retained and embedded in the shell 70 and the body 72. Relatively, the spring of the prior art can not be stably retained in the protective housing. In addition, the cable as disclosed in the present invention has a greater strength than that of the spring as disclosed in the prior art.

The lower end of the support member 6 is received in a sleeve 81 and is coupled to the ferrule 8 by a bolt 82 and a nut 83. The bolt 82 extends through the aperture 643 of the support member 6 and the shell 70. An inner thread 80 is formed in the lower end of the ferrule 8 and is threadedly engaged with the outer thread 40 which formed on the upper end of the intermediate tube 4 so that the support member 6 is stably coupled to the upper end of the intermediate tube 4. The sleeve 81 is stably retained in the ferrule 8.

Figure 4:
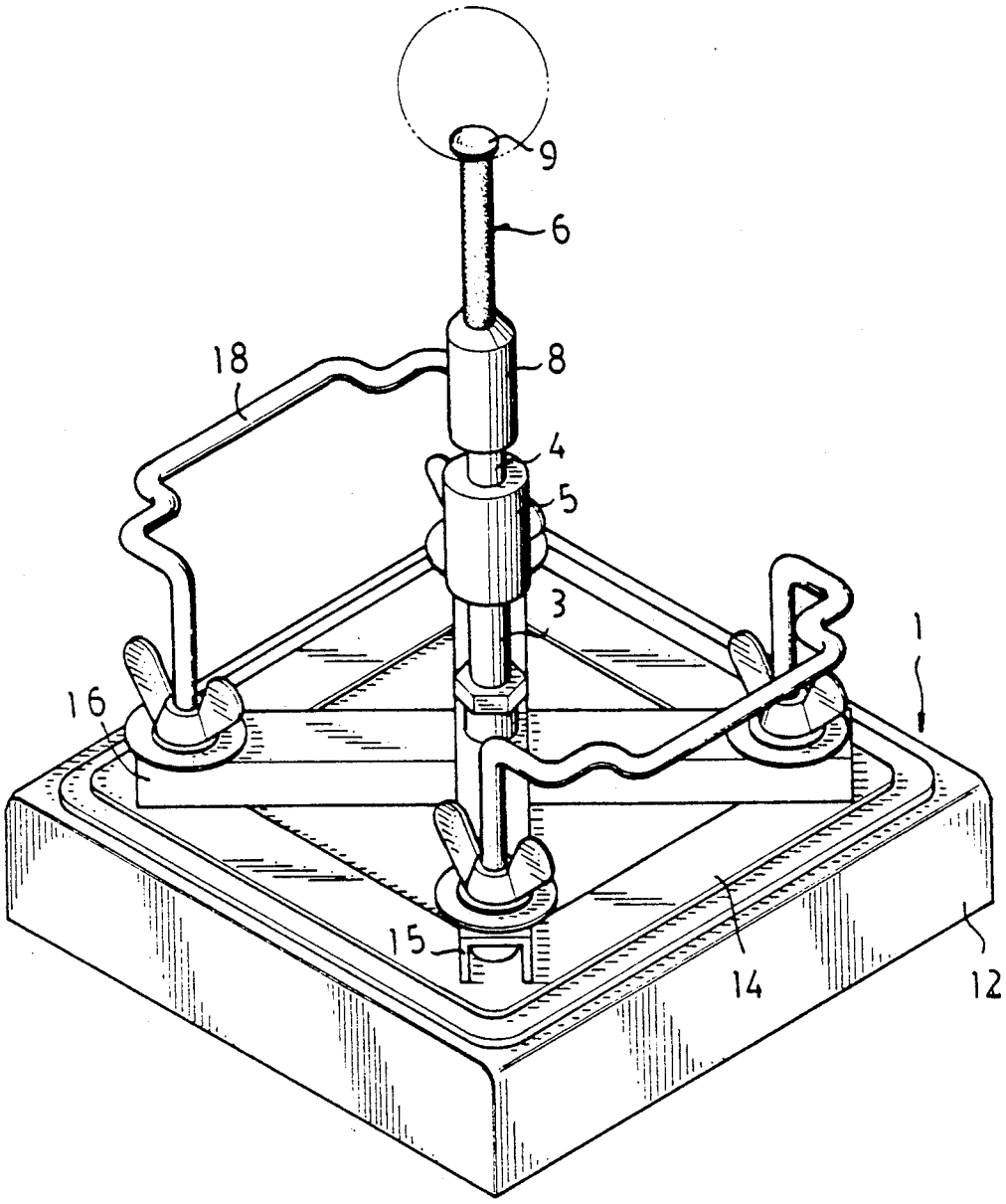
FIG. 4 is a perspective view of the device wherein a ball may be loosely placed upon the tee.

Referring next to FIG. 4, a tray 9 or a disc with a recess formed in an upper end thereof is provided on an upper end of the support member 6 instead of the body 72 and the upper element 68. A ball or the like can be loosely supported on the tray 9 for batting practice.

Accordingly, the device for batting and striking practice in accordance with the present invention has a support member which has a greater strength; and the core is stably retained in the shell thereof. The device in accordance with the present invention has greatly improved over the prior art.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A device for batting and striking practice comprising a base assembly, a vertically extending tube attached to said base assembly; an elongated, vertically extending support member coupled to an upper end of said tube by a fastening means, said support member includes a shell and a core element embedded in said shell, a body member integrally formed on an upper end of said support member, a first element clamped to a lower end of said core element, a second element clamped to an upper end of said core element and embedded in said body member, and each of said first element and said second element has at least one ring portion extended outward therefrom so that said core is stably retained and embedded in said shell and said body.

2. A device according to claim 1, wherein said core is a cable including an inner part and an outer part, said inner part and said outer part being rotatable in opposite directions about the longitudinal axis of said elongated support member so that said cable has a greater strength to resist distortion and deformation.

3. A device according to claim 1, wherein a plurality of holes are formed in each of said ring outward extending portions portions, said holes being filled with the material of said shell and body member so that said core element is stably retained in said shell and said body.

4. A device according to claim 1, wherein a third element is clamped on a middle portion of said core element, a second ring portion and a third ring portion extend outward from the lower end and the upper end of said third element, a plurality of holes are formed in said second ring portion and said third ring portion, said holes being filled with the material of said shell and said body member so that said core element is stably retained in said shell and said body.

5. A device according to claim 1, wherein an aperture is laterally formed through a lower end of said first element and said shell, said fastening means includes a sleeve received in a ferrule, the lower end of said support member being received in said sleeve, said lower end of said support member and said sleeve are coupled together by a bolt which extends through an aperture in said sleeve and said support member, and said ferrule is being threadedly attached to the upper end of said tube so that said support member is firmly and solidly connected on said upper end of said tube.

* * * * *